US008788265B2

(12) United States Patent
Laaksonen et al.

(10) Patent No.: US 8,788,265 B2
(45) Date of Patent: Jul. 22, 2014

(54) SYSTEM AND METHOD FOR BABBLE NOISE DETECTION

(75) Inventors: Laura Laaksonen, Espoo (FI); Päivi Valve, Tampere (FI)

(73) Assignee: Nokia Solutions and Networks Oy, Espoo (FI)

( * ) Notice: Subject to any disclaimer, the term of this patent is extended or adjusted under 35 U.S.C. 154(b) by 1847 days.

(21) Appl. No.: 10/853,819

(22) Filed: May 25, 2004

(65) Prior Publication Data

US 2005/0267745 A1 Dec. 1, 2005

(51) Int. Cl.
*G10L 21/02* (2013.01)
*G10L 19/00* (2013.01)

(52) U.S. Cl.
USPC ..... 704/226; 704/201; 704/200.1

(58) Field of Classification Search
USPC ..... 704/200, 201, 200.1, 226–228
See application file for complete search history.

(56) References Cited

U.S. PATENT DOCUMENTS

| | | | | |
|---|---|---|---|---|
| 5,596,676 | A * | 1/1997 | Swaminathan et al. | 704/208 |
| 6,658,380 | B1 * | 12/2003 | Lockwood et al. | 704/215 |
| 6,671,667 | B1 * | 12/2003 | Chandran et al. | 704/233 |
| 2002/0165713 | A1 * | 11/2002 | Skoglund et al. | 704/240 |
| 2002/0193130 | A1 * | 12/2002 | Yang et al. | 455/501 |

FOREIGN PATENT DOCUMENTS

WO WO/ 01 86633 A1 11/2001

OTHER PUBLICATIONS

Srinivasan et al, "Voice Activity Detection for Cellular Networks," IEEE Workshop on Speech Coding for Telecommunications, Oct. 13, 1993, pp. 85-86.*

Bou-Ghazale et al., "A Robust Endpoint Detection of Speech for Noisy Environments with Application to Automatic Speech Recognition", *Conexant Systems, Inc.*, pp. 3808-3811.

Beritelli, "A Robust Voice Activity Detector for Wireless Communications Using Soft Computing," *IEEE* 1998, pp. 1818-1829.

Jax et al., Feature Selection for Improved Bandwidth Extension of Speech Signals (IND), ICASSP 2004, pp. I-697-I-700.

Srinivasant et al., "Voice Activity Detection for Cellular Networks", *Department of Electrical and Computer Engineering*, pp. 85-86.

"Speech Processing, Transmission and Quality Aspects (STQ); Distributed speech recognition; Advanced front-end feature extraction algorithm; Compression algorithms" ETSI ES 202 0505 V1.1.3 (2203-11), pp. 1-45.

*Noise Suppression with Synthesis Windowing and Pseudo Noise Injection*, Multimedia Research Laboratories, Sep. 2002, Sugiyama et al., I-545-I548, France.

* cited by examiner

*Primary Examiner* — Angela A Armstrong
(74) *Attorney, Agent, or Firm* — Squire Patton Boggs (US) LLP

(57) ABSTRACT

A method, device, system, and computer program product calculate a gradient index as a sum of magnitudes of gradients of speech signals from a received frame at each change of direction; and provide an indication that the frame contains babble noise if the gradient index, energy information, and background noise level exceed pre-determined thresholds or a voice activity detector algorithm and sound level indicate babble noise.

19 Claims, 9 Drawing Sheets

SYSTEM AND METHOD FOR BABBLE NOISE DETECTION

FIELD OF THE INVENTION

The present invention relates to systems and methods for quality improvement in an electrically reproduced speech signal. More particularly, the present invention relates to a system and method for babble noise detection.

BACKGROUND OF THE INVENTION

Telephones can be used in many different environments. There is always some background noise around the speaker (far end) as well as around the listener (near end). The type and the level of the background noise can vary from stationary office and car noise to more non-stationary street and cafeteria noise. Many speech processing algorithms try to emphasize the actual speech signal and on the other hand reduce the unwanted masking effect of background noise, in order to improve the perceived audio quality and intelligibility. For these speech enhancement algorithms it is useful to know what kind of noise is present at either end of the transmission link because different noise situations require different performance from the algorithms. It is difficult to classify noises exactly but usually it is enough to classify noise according to its level and degree of mobility.

Telephones are often used in noisy environments and there is always some background noise summed to the speech signal. Many of the speech enhancement algorithms try to improve the quality and intelligibility of the transmitted speech signal by amplifying the actual speech and attenuating the background noise. For detecting the time slots of the signal that really contain speech, algorithms called voice activity detection (VAD) have been developed. These voice activity detection algorithms often interpret speech-like noise, hum of voices, as speech as well, which leads to undesired situations where background noise is amplified. To prevent these situations, a babble noise detection procedure, which determines if the speech detected by VAD is actual speech or just background babble, is needed.

In addition to algorithms using VAD information, some other speech enhancement algorithms, such as artificial bandwidth expansion (ABE), benefit from the background noise classification information. This information about the background noise enables an optimal performance of the algorithm in different noise situations. Babble noise situations often contain other non-stationary noise as well, like for example tinkle of dishes in a cafeteria or rustling of papers. Depending on the case, these sounds can also be included in the concept of babble noise and in that kind of situations it would be desired that the babble noise detector would detect these sounds as well.

In "Noise Suppression with Synthesis Windowing and Pseudo Noise Injection," A. Sugiyama, T. P. Hua, M. Kato, M. Serizawa, IEEE Proceedings of Acoustics, Speech, and Signal Processing, Volume: 1, 13-17 May 2002, babble noise was detected using zero-crossing information. The noise was considered babble noise if the average number of zero-crossings of a time domain signal exceeded a certain threshold.

Thus, there is a need for an improved technique for detecting babble noise. Further, there is a need to distinguish between speech and background noise. Even further, there is a need to combine results from separate detection algorithms for babble noise detection.

SUMMARY OF THE INVENTION

The present invention is directed to a method, device, system, and computer program product for detecting babble noise. Briefly, one exemplary embodiment relates to a method for detecting babble noise. The method includes receiving a frame of a communication signal including a speech signal; calculating a gradient index as a sum of magnitudes of gradients of speech signals from the received frame at each change of direction; and providing an indication that the frame contains babble noise if the gradient index, energy information, and background noise level exceed pre-determined thresholds.

Another exemplary embodiment relates to a device or module that detects babble noise in speech signals. The device include an interface that communicates with a wireless network and programmed instructions stored in a memory and configured to detect babble noise based on a spectral distribution of noise.

Another exemplary embodiment relates to a device or module that detects babble noise in speech signals. The device includes an interface that sends and receives speech signals and programmed instructions stored in a memory and configured to detect babble noise based on a voice activity detector algorithm.

Yet another exemplary embodiment relates to a system for detecting babble noise. The system includes means for receiving a frame of a communication signal including a speech signal; means for calculating a gradient index as a sum of magnitudes of gradients of speech signals from the received frame at each change of direction; and means for providing an indication that the frame contains babble noise if the gradient index, energy information, and background noise level exceed pre-determined thresholds.

Yet another exemplary embodiment relates to a computer program product that detects babble noise. The computer program product includes computer code to calculate a gradient index as a sum of magnitudes of gradients of speech signals from a received frame at each change of direction; and provide an indication that the frame contains babble noise if the gradient index, energy information, and background noise level exceed pre-determined thresholds or a voice activity detector algorithm and sound level indicate babble noise.

Other principle features and advantages of the invention will become apparent to those skilled in the art upon review of the following drawings, the detailed description, and the appended claims.

BRIEF DESCRIPTION OF THE DRAWINGS

Exemplary embodiments will hereafter be described with reference to the accompanying drawings.

DETAILED DESCRIPTION OF EXEMPLARY EMBODIMENTS

Figure 1:
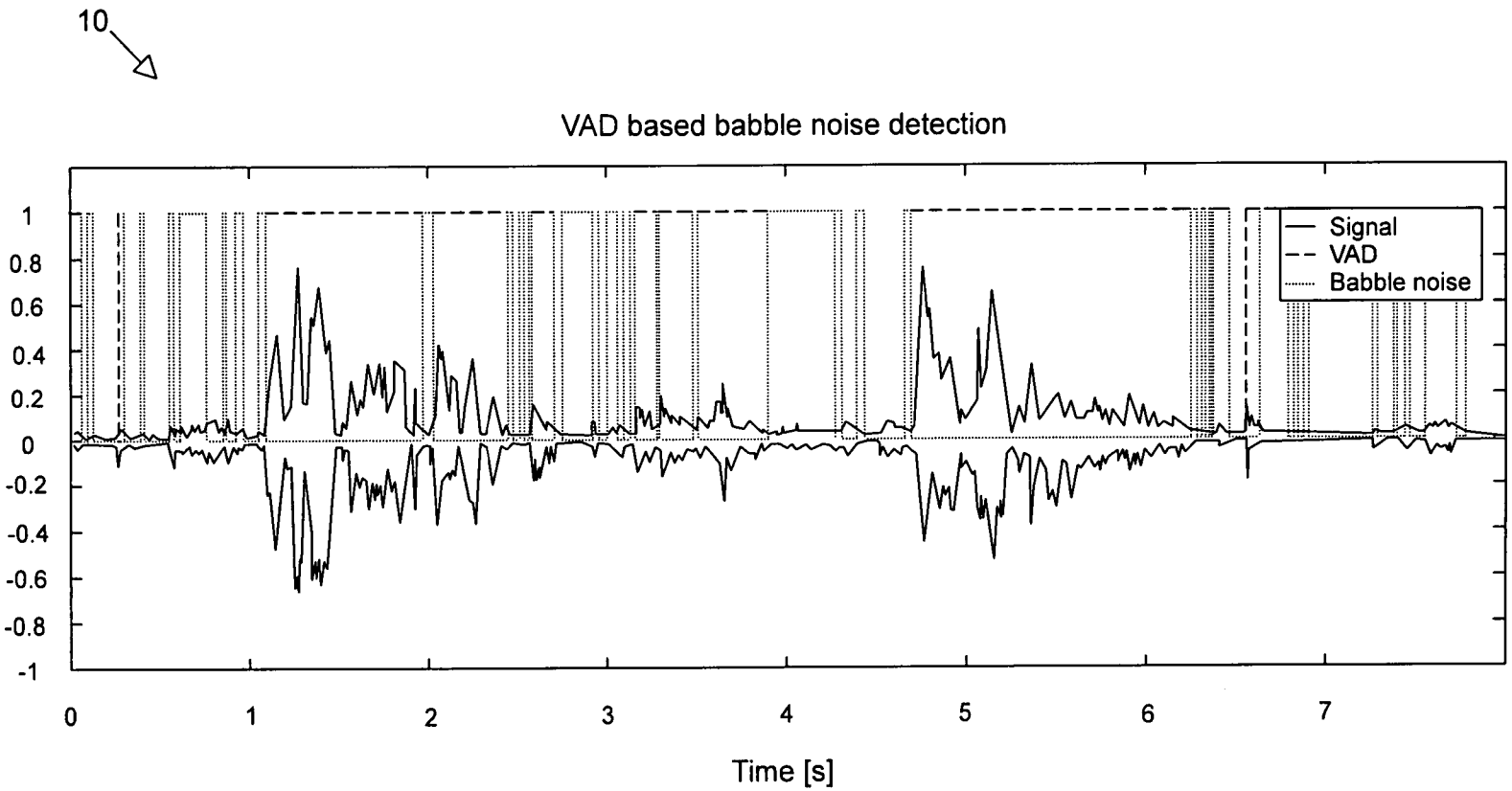
FIGS. 1 and 2 are graphs depicting exemplary outputs of babble noise detection algorithms.
Figure 2:
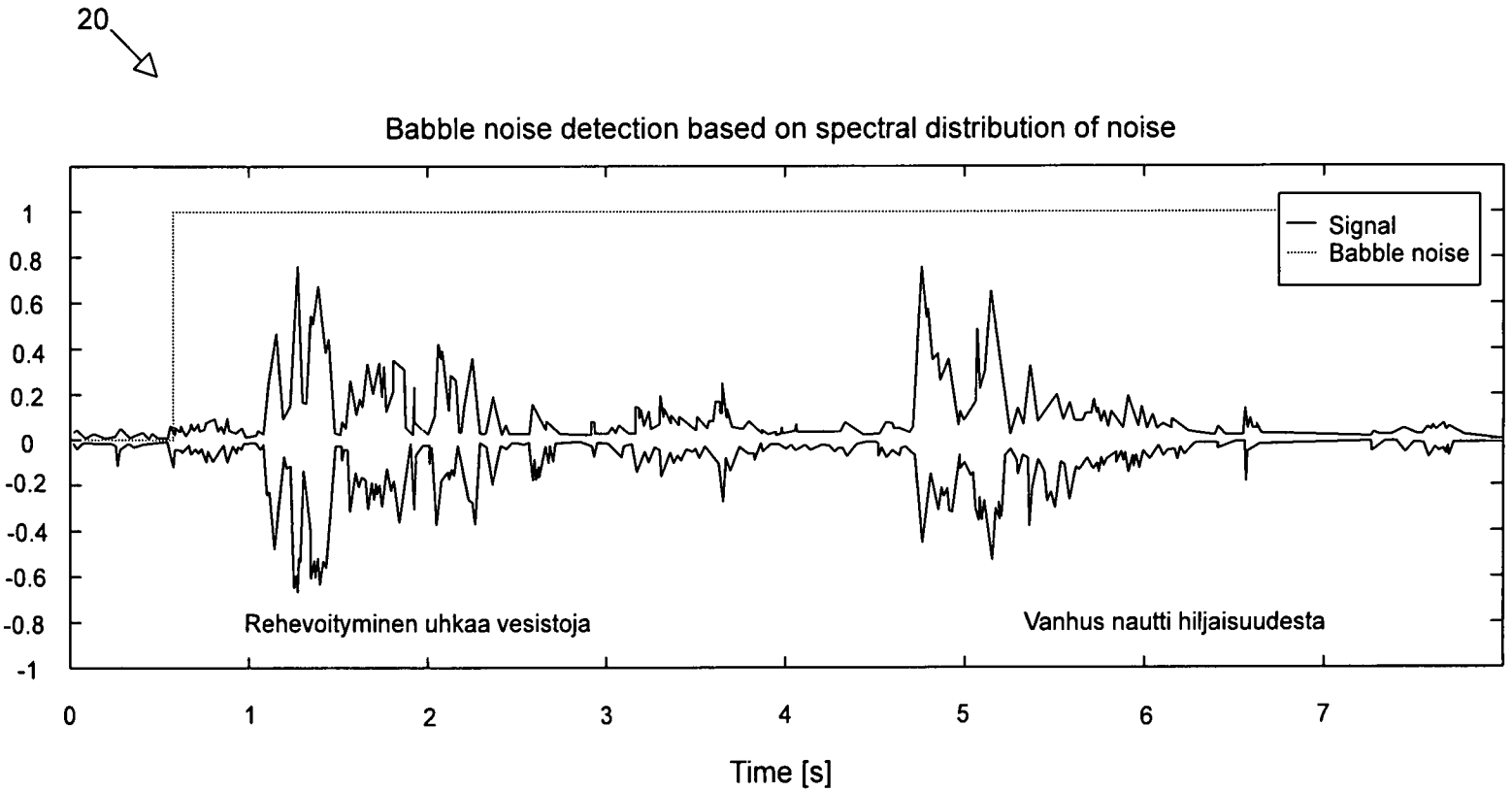

FIGS. 1-2 illustrate graphs 10 and 20 depicting signal output for a VAD algorithm (FIG. 1) and a spectral distribution algorithm (FIG. 2) consisting of two sentences with babble background noise. The dashed line in graph 10 of FIG. 1 is the VAD decision where logical 1 corresponds to detected speech. The dotted line in graph 10 of FIG. 1 is the babble decision made by the VAD based babble noise detection algorithm. The dotted line in graph 20 of FIG. 2 is the babble decision made by the feature-based algorithm.

Figure 3:
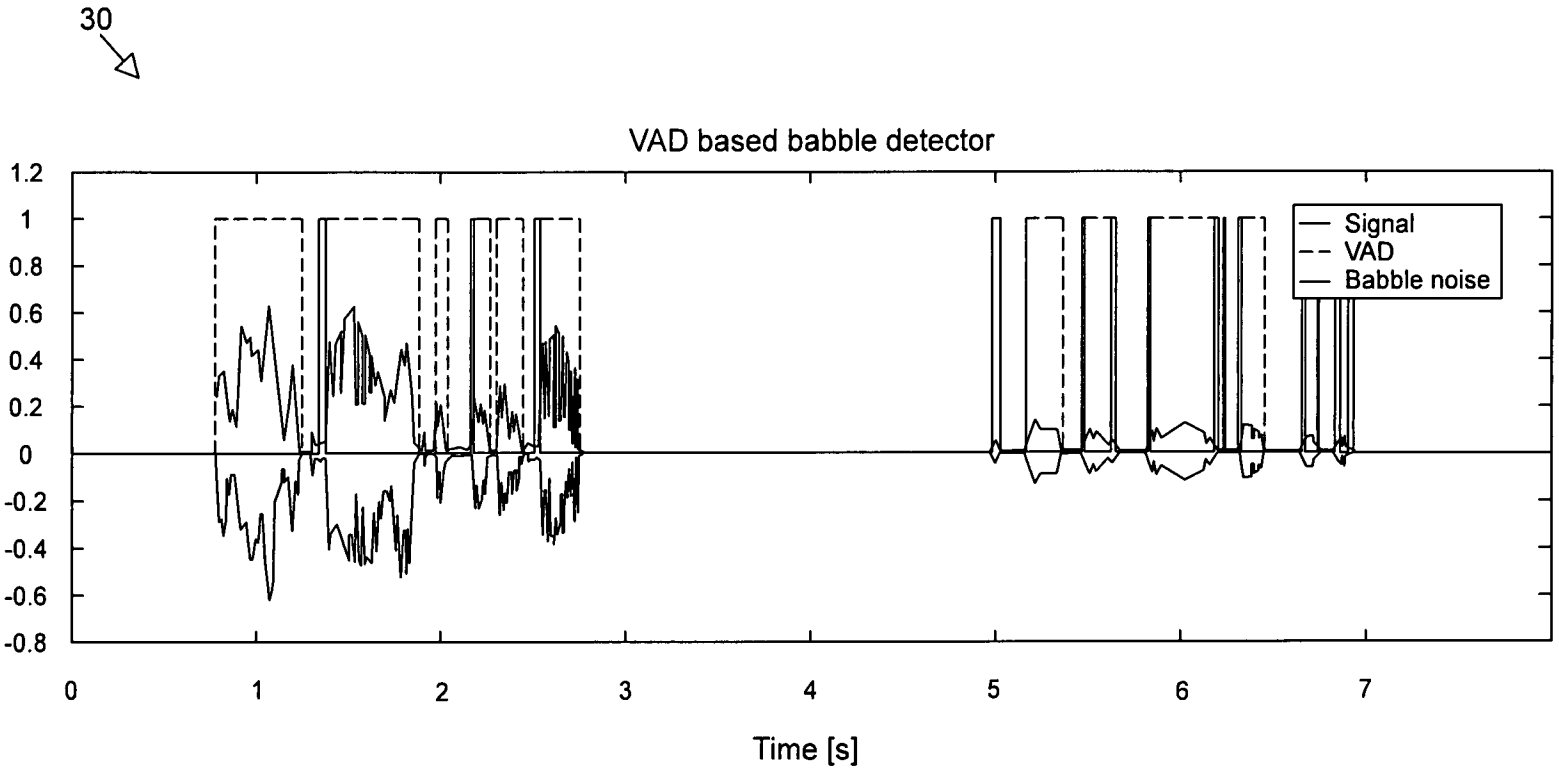
FIGS. 3 and 4 are graphs depicting exemplary outputs of babble noise detection algorithms.
Figure 4:
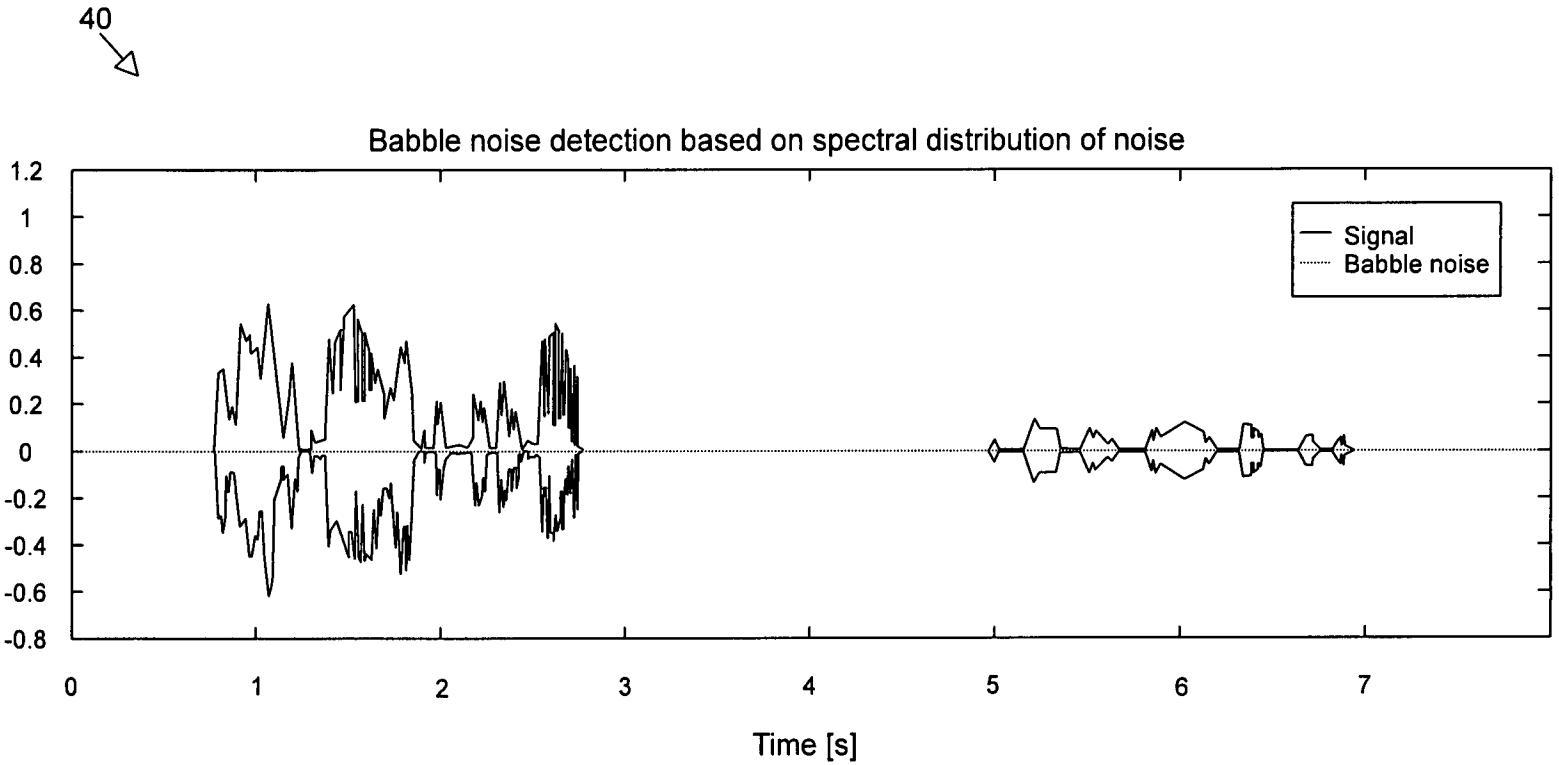

FIGS. 3-4 illustrate graphs 30 and 40 depicting signal output for a VAD algorithm (FIG. 3) and a spectral distribution algorithm (FIG. 4) consisting of two sentences. The graph 30 depicts the output for a VAD based detection algorithm. The graph 30 shows that the second sentence is incorrectly almost completely detected as babble noise because the level of the second sentence is lower than the first one. In contrast, the graph 40 depicts the output for babble noise detection based on spectral distribution of noise. The graph 40 shows no babble noise is detected.

Figure 5:
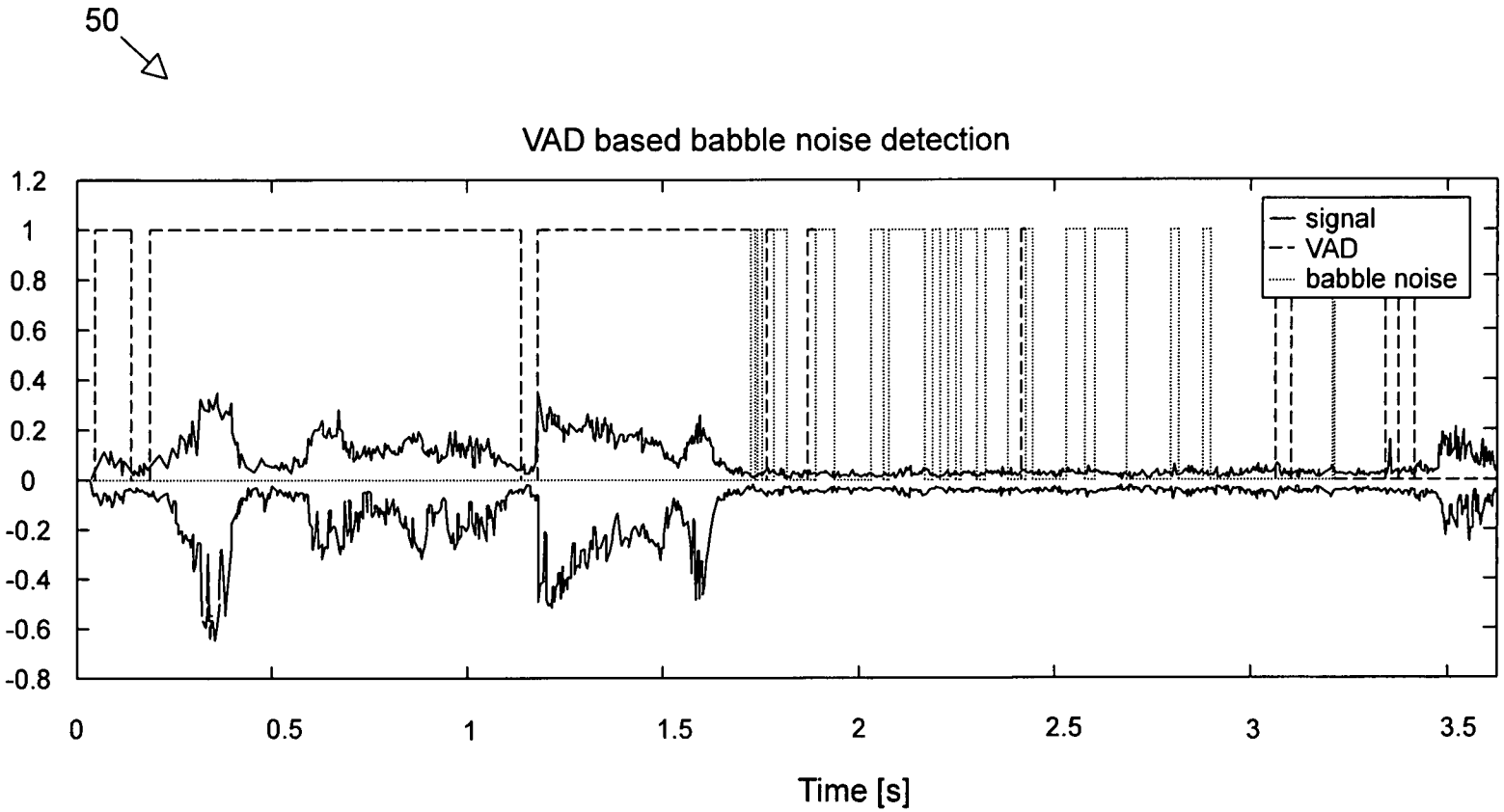
FIGS. 5 and 6 are graphs depicting exemplary outputs of babble noise detection algorithms.
Figure 6:
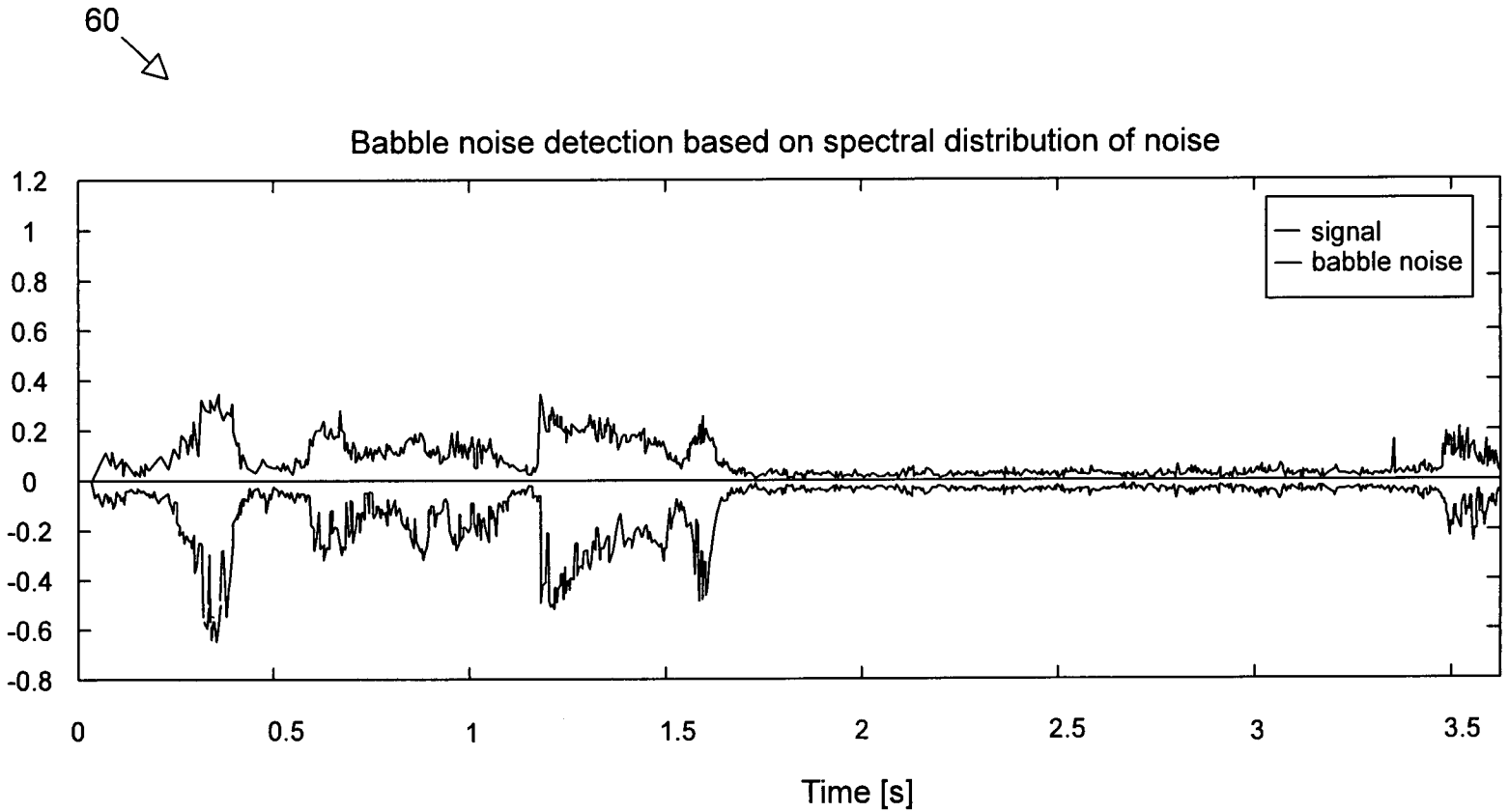

FIGS. 5-6 illustrate graphs 50 and 60 depicting signal output for a VAD algorithm (FIG. 5) and a spectral distribution algorithm (FIG. 6) consisting of a sentence followed by quiet babble noise. The graph 50 depicts the output for a VAD based detection algorithm. The graph 50 shows that the babble noise is detected. In contrast, the graph 60 depicts the output for babble noise detection based on spectral distribution of noise. The graph 60 shows that the algorithm fails to detect babble noise because of its low-pass characteristics.

Accordingly, babble noise can be better detected when a VAD based algorithm and a spectral distribution algorithm are combined or used separately in the situations which fit best to the particular algorithm chosen. In an exemplary embodiment, both of the algorithms process the input signal in 10 ms frames.

In general, voice activity detection (VAD) algorithms often interpret speech-like noise, hum of voices as speech. The VAD based babble noise detection algorithm corrects those incorrect decisions made by VAD by monitoring the level of detected speech, since the level of hum is usually lower than the level of the actual speech. If the input signal level suddenly drops by more than a predetermined amount (such as 5 dB, 25 db<50 dB, ect.) from its long-term estimate, the assumption of the babble noise situation is made. The VAD based babble noise detection algorithm detects only babble noise that really is hum of voices.

The spectral distribution algorithm is based on a feature vector and it follows the longer-term background noise conditions. It monitors only the characteristics of noise without taking into account the decision of VAD, e.g. the information if the frame contains speech or not. The babble noise detection is based on features that reflect the spectral distribution of frequency components and, thus, make a difference between low frequency noise and babble noise that has more high frequency components. The spectral distribution based algorithm detects hum of voices as well as other non-stationary noise as babble noise.

Since these algorithms define and detect babble noise differently, in some cases it is advantageous to combine the information they can provide. How this is done depends on the definition of babble noise and the needed accuracy of babble noise detection. For example, the spectral distribution babble noise decision can be used to double-check the negative or positive babble noise decision made by the VAD based detection algorithm.

Babble noise detection based on spectral distribution of noise is based on three features: gradient index based feature, energy information based feature and background noise level estimate. The energy information, $E_i$, is defined as:

$$E_i = \frac{E[s''_{nb}(n)]}{E[s_{nb}(n)]},$$

where s(n) is the time domain signal, $E[s'_{nb}]$ is the energy of the second derivative of the signal and $E[s_{nb}]$ is the energy of the signal. For babble noise detection, the essential information is not the exact value of $E_i$, but how often the value of it is considerably high. Accordingly, the actual feature used in babble noise detection is not $E_i$ but how often it exceeds a certain threshold. In addition, because the longer-term trend is of interest, the information whether the value of $E_i$ is large or not is filtered. This is implemented so, that if the value of energy information is greater than a threshold value, then the input to the IIR filter is one, otherwise it is zero. The IIR filter is of form:

$$H(z) = \frac{1-a}{1-az^{-1}},$$

where a is the attack or release constant depending on the direction of change of the energy information.

The energy information has high values also when the current speech sound has high-pass characteristics, such as for example /s/. In order to exclude these cases from the IIR filter input, the IIR-filtered energy information feature is updated only when the frame is not considered as a possible sibilant (i.e., the gradient index is smaller than a predefined threshold).

Gradient index is another feature used in babble noise detection. In babble noise detection, the gradient index is IIR filtered with the same kind of filter as was used for energy information feature. The background noise level estimation can be based on, for example, a method called minimum statistics.

If all three features, (IIR-filtered energy information, IIR-filtered gradient index and background noise level estimate) exceed certain thresholds, then the frame is considered to contain babble noise. By requiring all there features to exceed certain thresholds, this embodiment of the invention can minimize the number of false positives (i.e. the number of times a frame is incorrectly considered to contain babble noise). In at least one embodiment, in order to make the babble noise detection algorithm more robust, fifteen consecutive stationary frames are used to make the final decision that the algorithm operates in stationary noise mode. The transition from stationary noise mode to babble noise mode on the other hand requires only one frame.

Voice activity detector (VAD) algorithms are used to interpret time instants when the signal contains speech instead of mere background noise. These algorithms often interpret speech-like noise also as speech. However, the level of this kind of hum of voices is usually lower than the level of the actual speech. Using this assumption it is possible to monitor the level of the input signal, interpreted as speech by the VAD, and compare it to its long-term estimate. If the input signal level suddenly drops by more than, for example, 15 dB from its long-term estimate, an assumption of the babble noise situation is made. During babble noise, the long-term speech estimate is kept intact.

If the level of the actual speech signal drops suddenly, the babble noise detection algorithm triggers falsely. This result would prevent the updating of the long-term speech level estimate. For these kind of situations, the algorithm has a safety control, which is performed after 20-30 seconds. This safety control forces the update of the long-term estimate, if short-term estimate has not reached the long-term estimate for a given number of samples. The time period of 20-30 seconds is justified because it is somewhat the typical maximum time a person keeps completely silent in a telephone conversation, and thus the long-term estimate should be updated more frequently than that.

These two separate babble noise detection algorithms both have their advantages and disadvantages. Fortunately, these algorithms usually fail in different situations. How the combining of the babble noise detection decisions of the algorithms should be done, depends on the situation since the definition of babble noise is not exact and speech processing algorithms need the babble noise detection information for different reasons.

Figure 7:
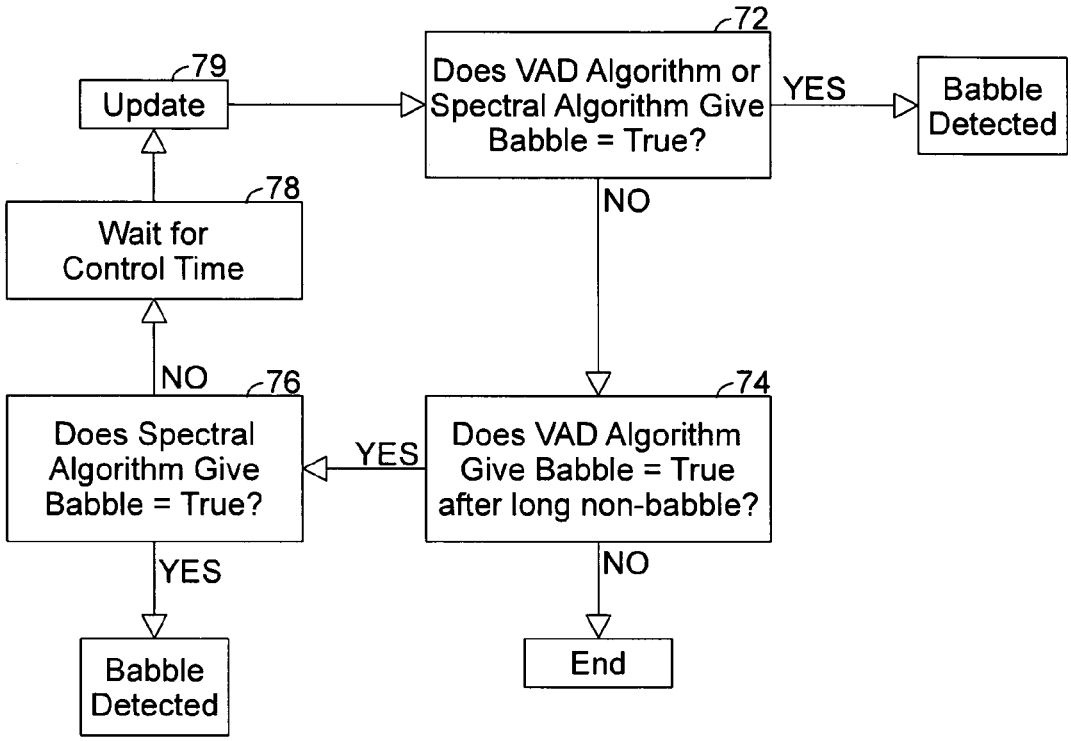
FIG. 7 is a flow diagram depicting operations performed in the combination of babble noise detection algorithms in accordance with an exemplary embodiment.

FIG. 7 illustrates a flow diagram depicting exemplary operations performed in the combination of the VAD and spectral distribution algorithms to detect babble noise. Additional, fewer, or different operations may be performed, depending on the embodiment. In a block 72, babble noise is detected if either of the algorithms gives a logical 1 (i.e., positive babble noise decision). Such a combination could be used in cases were it is vital to detect babble noise and the concept of babble noise is wide.

If the VAD based algorithm detects babble after a long non-babble period in block 74, the decision of the spectral distribution algorithm is checked in block 76 before making the final babble decision. If the spectral distribution algorithm gives a logical 1 as well, babble is detected, if not, there is a wait period in block 78 of a control safety time (e.g., 20-30 seconds). The long-term estimate is then updated in block 79 and the babble decision is made after that. This combination could be used, for example, if faulty babble noise detections are a problem. Occasions where quiet speech is faulty detected as babble noise would be prevented.

Figure 8:
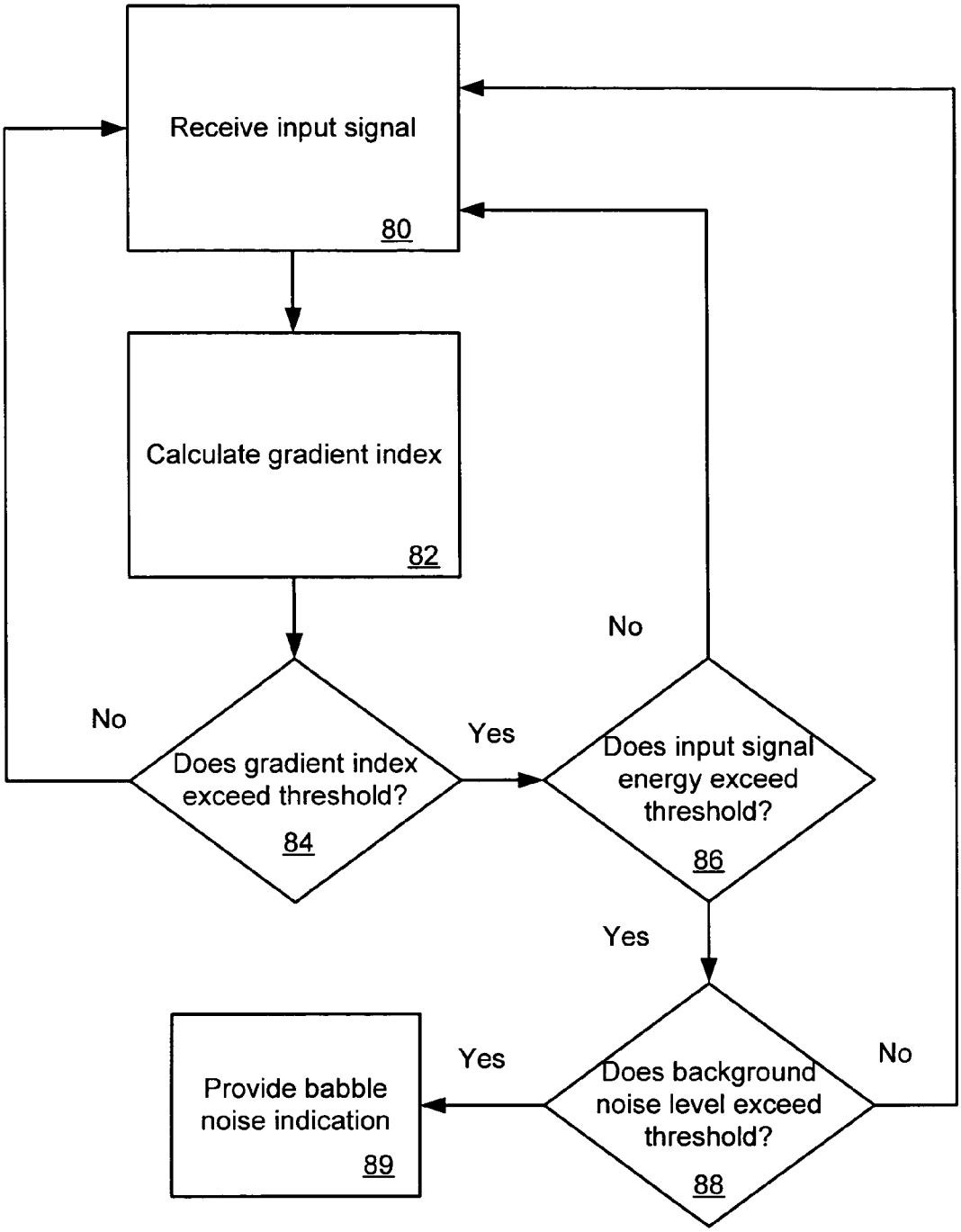
FIG. 8 is a flow diagram depicting operations performed by a spectral distribution based algorithm in accordance with an exemplary embodiment.

FIG. 8 illustrates a flow diagram depicting exemplary operations performed in a spectral distribution based algorithm used to detect babble noise. Additional, fewer, or different operations may be performed, depending on the embodiment. In block 80, an input signal is received and in block 82, a gradient index is calculated, for example as described herein. In block 84, the gradient index is compared to a predetermined gradient index threshold. If the gradient index does not exceed the threshold, the algorithm returns to block 80 and additional input signal is received. If the gradient index does exceed the threshold, the input signal energy is compared to a predetermined input signal energy threshold in block 86. If the input signal energy does not exceed the predetermined threshold, the algorithm returns to block 80 and additional input signal is received. If the input signal energy does exceed the threshold, the background noise level is compared to a predetermined background noise level threshold in block 88. If the background noise level does not exceed the threshold, the algorithm returns to block 80 and additional input signal is received. If the background noise level does exceed the threshold, an indication that the input signal includes babble noise is made in block 89.

Figure 9:
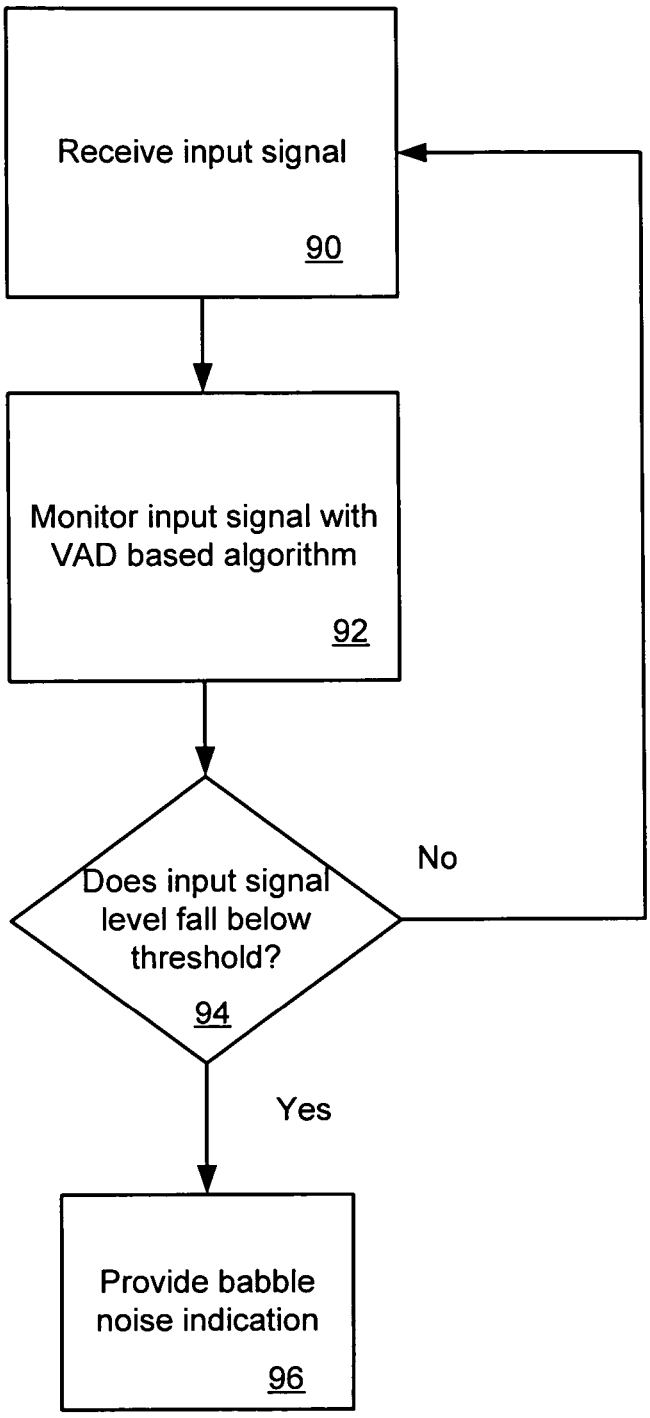
FIG. 9 is a flow diagram depicting operations performed by a voice activity detection based algorithm in accordance with an exemplary embodiment.

FIG. 9 illustrates a flow diagram depicting exemplary operations performed in a VAD based algorithm used to detect babble noise. Additional, fewer, or different operations may be performed, depending on the embodiment. In block 90, an input signal is received and in block 92 the input signal is monitored by a VAD based algorithm. In block 94, the VAD based algorithm compares the input signal to a predetermined input signal threshold and if the input signal level suddenly falls below the predetermined threshold, an indication that the input signal includes babble noise is made in block 96. If the input signal level does not fall below the predetermined threshold, the algorithm returns to block 90 and additional input signal is received.

Advantageously, depending on the purpose of usage, only one of the algorithms or both of them can be used to detect babble noise. Further, combining the separate detection algorithms helps overcome their problems by using their strengths.

This detailed description outlines exemplary embodiments of a method, device, and system for babble noise detection. In the foregoing description, for purposes of explanation, numerous specific details are set forth in order to provide a thorough understanding of the present invention. It is evident, however, to one skilled in the art that the exemplary embodiments may be practiced without these specific details. In other instances, structures and devices are shown in block diagram form in order to facilitate description of the exemplary embodiments.

While the exemplary embodiments illustrated in the Figures and described above are presently preferred, it should be understood that these embodiments are offered by way of example only. Other embodiments may include, for example, different techniques for performing the same operations. The invention is not limited to a particular embodiment, but extends to various modifications, combinations, and permutations that nevertheless fall within the scope and spirit of the appended claims.

What is claimed is:

1. A method, comprising:

receiving an input signal including a speech signal;

calculating a gradient index as a sum of magnitudes of gradients of speech signals from the received input signal at each change of direction;

providing an indication that the input signal contains babble noise when the gradient index, energy information, and background noise level exceed pre-determined thresholds; and forcing an update of a long-term speech level estimate as a result of determining that the babble noise has been falsely indicated when a short-term speech level estimate does not reach the long-term speech level estimate for a given number of samples.

2. The method claim 1, further comprising performing a voice activity detector algorithm to determine whether the input signal contains babble noise.

3. The method of claim 2, wherein providing an indication that the input signal contains babble noise further comprises determining whether the input signal contains babble noise based on the gradient index, energy information, and background noise level exceeding pre-determined thresholds and/or a sound level of the input signal and the voice activity detector algorithm.

4. The method of claim 1, further comprising filtering the energy information and the gradient index.

5. The method of claim 4, wherein filtering the energy information and the gradient index is of the form $$H(z) = \frac{1-a}{1-az^{-1}},$$

where a is an attack or release constant depending on the direction of change of the energy information.

6. The method of claim 4, wherein energy information and the gradient index are filtered using an IIR filter.

7. A method, comprising:

receiving an input signal including a speech signal;

calculating a gradient index as a sum of magnitudes of gradients of speech signals from the received input signal at each change of direction;

monitoring the input signal level using a voice activity detector algorithm;

providing an indication that the input signal contains babble noise when the input signal level falls below a predetermined threshold level or when the gradient index, energy information, and background noise level exceed predetermined thresholds; and forcing an update of a long-term speech level estimate as a result of determining that the babble noise has been falsely indicated when a short-term speech level estimate does not reach the long-term speech level estimate for a given number of samples.

8. A device, comprising:

an interface configured to communicate with a wireless network;

programmed instructions stored in a memory and configured to detect babble noise based on a spectral distribution of noise in accordance with gradient index, energy information and background noise level associated with a speech signal and configured to force an update a long-term speech level estimate as a result of determining that the babble noise has been falsely indicated when a short-term speech level estimate does not reach the long-term speech level estimate for a given number of samples.

9. The device of claim 8, wherein the spectral distribution of noise comprises checking whether a gradient index, energy information, and background noise level exceed predetermined thresholds.

10. The device of claim 8, further comprising programmed instructions to detect babble noise based on a voice activity detector algorithm.

11. The device of claim 8, wherein the detection of babble noise requires only one frame of speech signal.

12. The device of claim 8, further comprising filtering the energy information and the gradient index.

13. A system, comprising:

means for receiving a communication signal including a speech signal;

means for calculating a gradient index as a sum of magnitudes of gradients of speech signals from the received communication signal at each change of direction;

means for providing an indication that the communication signal contains babble noise when the gradient index, energy information, and background noise level exceed pre-determined thresholds; and means for forcing an update of a long-term speech level estimate as a result of determining that the babble noise has been falsely indicated when a short-term speech level estimate does not reach the long-term speech level estimate for a given number of samples.

14. The system of claim 13, further comprising means for determining whether the communication signal contains babble noise based on the gradient index, energy information, and background noise level exceeding pre-determined thresholds and/or a sound level of the communication signal and a voice activity detector algorithm.

15. The system of claim 14, further comprising means for detecting babble noise when the voice activity detector algorithm or the gradient index, energy information, and background noise level exceeds pre-determined thresholds is a false positive result.

16. A computer program product, embodied on a non-transitory computer readable medium, the computer program product comprising:

computer code which, when run on a processor, controls the processor to:

calculate a gradient index as a sum of magnitudes of gradients of speech signals from a received input signal at each change of direction;

provide an indication that the input signal contains babble noise when the gradient index, energy information, and background noise level exceed pre-determined thresholds or a voice activity detector algorithm and sound level indicate babble noise; and force an update of a long-term speech level estimate as a result of determining that the babble noise has been falsely indicated when a short-term speech level estimate does not reach the long-term speech level estimate for a given number of samples.

17. The computer program product of claim 16, wherein when no babble noise is indicated and the voice activity detector algorithm indicates babble noise after a period of time and the gradient index, energy information, and background noise level exceed predetermined thresholds, the computer code provides an indication that the input signal contains babble noise.

18. The computer program product of claim 16, wherein when no babble noise is indicated and the voice activity detector algorithm indicates babble noise after a period of time and the gradient index, energy information, and background noise level do not exceed pre-determined thresholds, the computer code waits a time, updates the input signal, and checks for babble noise in the updated input signal.

19. The computer program product of claim 18, wherein the computer code further controls the processor to filter the gradient index and energy information.

* * * * *